US009228545B2

(12) United States Patent
Rosenfeld et al.

(10) Patent No.: US 9,228,545 B2
(45) Date of Patent: Jan. 5, 2016

(54) INTAKE AIR PRE-CLEANER

(71) Applicant: CATERPILLAR INC., Peoria, IL (US)

(72) Inventors: Mark Alan Rosenfeld, Peoria, IL (US); Bobby Jene Kinsey, Jr., Washington, IL (US); Jeffrey Ries, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 56 days.

(21) Appl. No.: 14/206,623

(22) Filed: Mar. 12, 2014

(65) Prior Publication Data

US 2014/0260129 A1 Sep. 18, 2014

Related U.S. Application Data

(60) Provisional application No. 61/777,434, filed on Mar. 12, 2013.

(51) Int. Cl.

*F02M 35/022* (2006.01)
*F02M 35/02* (2006.01)
*F02M 35/08* (2006.01)

(52) U.S. Cl.

CPC ..... *F02M 35/0215* (2013.01); *F02M 35/0216* (2013.01); *F02M 35/0223* (2013.01); *F02M 35/086* (2013.01)

(58) Field of Classification Search

CPC ..... B01D 45/04; B01D 45/16; B01D 50/002; B01D 2279/60; F02M 35/022; F02M 35/08; F02M 35/10013; F02M 35/02; Y10S 55/28
USPC ..... 55/345, 385.3, 447, 456, DIG. 28; 95/272; 96/372; 123/198 E
See application file for complete search history.

(56) References Cited

U.S. PATENT DOCUMENTS

| | | | | |
|---|---|---|---|---|
| 2,661,810 | A * | 12/1953 | Heth | 55/301 |
| 3,791,112 | A * | 2/1974 | Lidstone | 55/385.3 |
| 3,884,658 | A * | 5/1975 | Roach | 55/315 |
| 4,482,365 | A * | 11/1984 | Roach | 96/408 |
| 4,746,340 | A * | 5/1988 | Durre et al. | 55/347 |
| 8,177,872 | B2 * | 5/2012 | Nelson et al. | 55/345 |
| 2008/0016832 | A1 * | 1/2008 | Krisko et al. | 55/342 |
| 2011/0048368 | A1 | 3/2011 | Nelson et al. | |
| 2011/0072769 | A1 | 3/2011 | Vladaj et al. | |

FOREIGN PATENT DOCUMENTS

EP 2245295 A1 3/2010

* cited by examiner

*Primary Examiner* — Duane Smith
*Assistant Examiner* — Minh-Chau Pham
(74) *Attorney, Agent, or Firm* — Finnegan, Henderson, Farabow, Garrett & Dunner, LLP

(57) ABSTRACT

A pre-cleaner for use with an internal combustion engine includes a base having a substantially planar interior surface, a scavenge port, and a plurality of separators extending substantially perpendicularly from the interior surface. The pre-cleaner also includes a baffle removably connected to the base, the baffle having a plurality of separator features configured to mate with the plurality of separators. The pre-cleaner further includes a deck disposed between the interior surface and the baffle. The deck is positioned at an acute angle relative to the interior surface such that a first portion of the deck is disposed closer to the interior surface than a second portion of the deck.

23 Claims, 8 Drawing Sheets

INTAKE AIR PRE-CLEANER

RELATED APPLICATIONS

This application is based on and claims the benefit of priority from U.S. Provisional Application No. 61/777,434, filed Mar. 12, 2013, the contents of which are expressly incorporated herein by reference.

TECHNICAL FIELD

The present disclosure is directed to a pre-cleaner and, more particularly, to a pre-cleaner for use with an internal combustion engine.

BACKGROUND

Machines used in the farming, construction, mining, power generation, and other like industries commonly include a frame that supports an internal combustion engine, a work tool movably connected to the frame, and at least one hydraulic cylinder connected between the frame and the work tool and driven by the engine. Such machines typically operate in harsh environments characterized by large amounts of airborne dust, dirt, and debris. In such environments, it is desirable to remove such debris from the air before directing the air to the engine. To assist with this process, such machines typically include an intake air filter or other like air cleaner configured to remove airborne debris upstream of the engine. Further, to assist in prolonging the useful life of such air cleaners, some machines may also include a pre-cleaner configured to remove relatively large debris from the intake air stream prior to cleaning the intake air with the air cleaner.

An exemplary air intake system employing a pre-cleaner is disclosed in U.S. Pat. No. 8,177,872 ("the '872 patent"), issued May 15, 2012. The pre-cleaner taught in the '872 patent includes a plurality of intertial separators disposed within a housing that is fluidly connected upstream of an engine air cleaner. As intake air is drawn into the housing, the inertial separators remove relatively large debris particles from the air and deposit them within the housing. These particles are then removed from the housing via a scavenge pipe fluidly connected to the exhaust system of the engine.

While the system of the '872 patent may be configured to remove relatively large debris particles from intake air, such systems are known to have several drawbacks. For example, in relatively high-debris environments, the inertial separators used in such systems are easily clogged. Once clogged, such separators can be difficult to clean due to their size, location, and configuration. Additionally, as such separators become clogged, air flow through the pre-cleaner is reduced. If left unchecked, this reduction in air flow can create an area of low pressure within the pre-cleaner strong enough to draw high temperature exhaust into the pre-cleaner. Such high temperature exhaust can damage the pre-cleaner and can have unwanted effects on the combustion process within the engine.

Moreover, scavenge pipes of the type disclosed in the '872 patent often have difficulty removing debris that has been collected within the pre-cleaner housing. Since the vacuum flow through such scavenge pipes is typically dictated by engine speed, the debris removal capabilities of such scavenge pipes can be significantly reduced at engine idle or other modes of engine operation characterized by relatively low engine speed. As a result, collected debris can accumulate within the housing over time. Due to the number and close proximity of inertial separators employed by such pre-cleaners, operators may have difficulty manually removing such accumulated debris from the pre-cleaner housing, and this built-up debris can reduce the efficiency of the pre-cleaner.

The exemplary embodiments of the present disclosure are directed toward overcoming one or more of the problems set forth above and/or other problems of the prior art.

SUMMARY

In an exemplary embodiment of the present disclosure, a pre-cleaner for use with an internal combustion engine includes a base having a substantially planar interior surface, a scavenge port, and a plurality of separators extending substantially perpendicularly from the interior surface. The pre-cleaner also includes a baffle removably connected to the base, the baffle having a plurality of separator features configured to mate with the plurality of separators. The pre-cleaner further includes a deck disposed between the interior surface and the baffle. The deck is positioned at an acute angle relative to the interior surface such that a first portion of the deck is disposed closer to the interior surface than a second portion of the deck.

In another exemplary embodiment of the present disclosure, a pre-cleaner for use with an internal combustion engine includes a base having a substantially planar interior surface, a plurality of scavenge ports fluidly connected to the interior surface, and a plurality of separators extending substantially perpendicularly from the interior surface. The pre-cleaner also includes a baffle removably connected to the base opposite the interior surface and configured to mate with the plurality of separators. The pre-cleaner further includes a plenum fluidly connected to the plurality of scavenge ports and disposed proximate an exterior surface of the base opposite the interior surface.

In a further exemplary embodiment of the present disclosure, an intake system for use with an internal combustion engine includes a pre-cleaner having a base including an inlet, an outlet, and a scavenge port. The inlet is configured to receive intake air, and the scavenge port includes an orifice formed by a substantially planar interior surface of the base. The intake system also includes an air filter fluidly connected to the outlet and configured to receive pre-cleaned air from the outlet. The intake system further includes an exhaust passage fluidly connected to the engine and the scavenge port. The exhaust passage is configured to receive combustion exhaust from the engine and to receive debris removed from the intake air by the pre-cleaner. The intake system further includes a fan fluidly connected to the exhaust passage and configured to direct the debris from the pre-cleaner to the exhaust passage via the orifice of the scavenge port.

DETAILED DESCRIPTION

Figure 1:
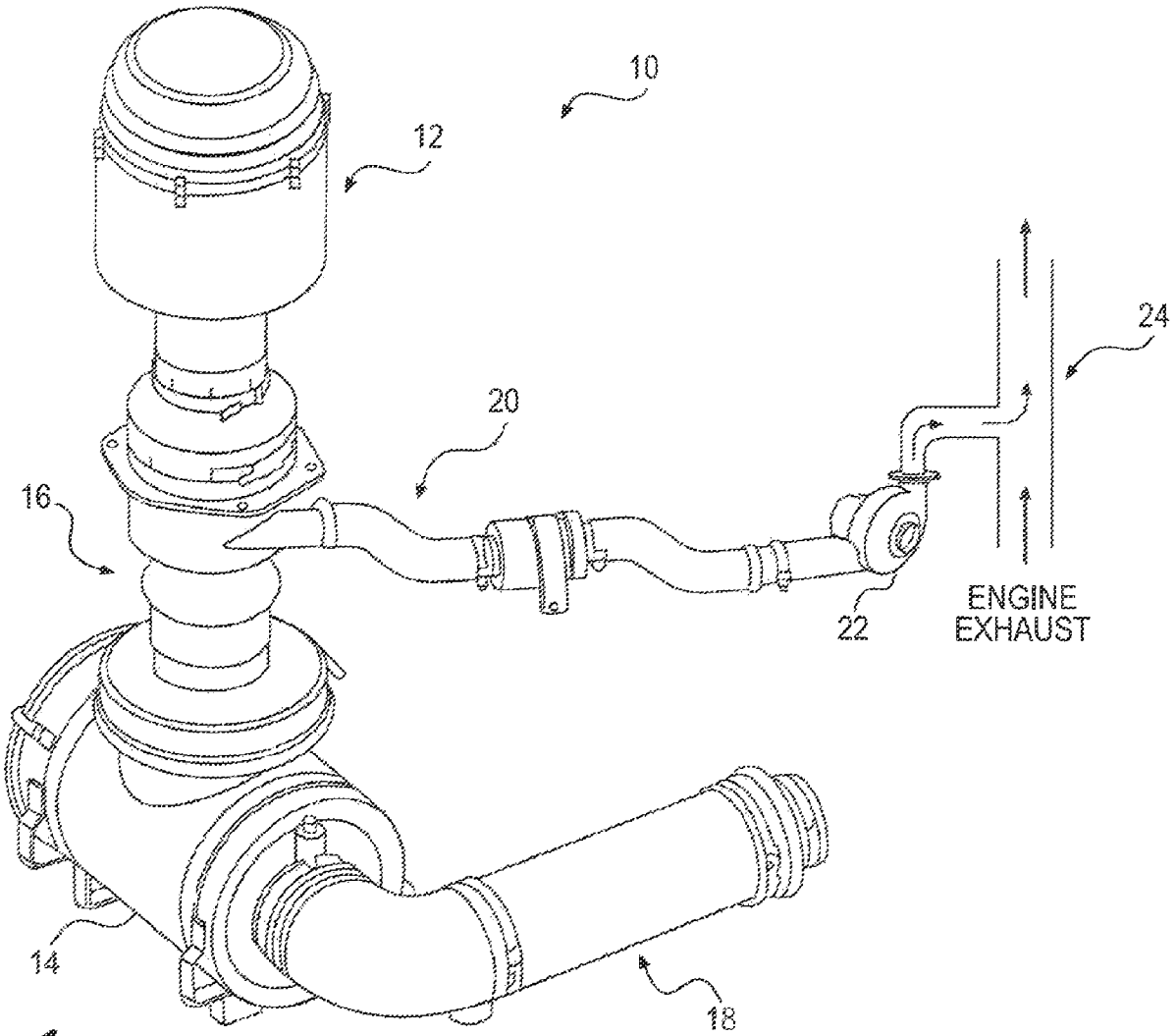
FIG. 1 is a pictorial illustration and partial schematic view of an exemplary intake system of the present disclosure.

FIG. 1 illustrates an exemplary air intake system 10 of the present disclosure. Intake system 10 may be configured for use with an internal combustion engine (not shown) or any other engine known in the art. In particular, intake system 10 may be configured to receive environmental air (referred to herein as "intake air"), remove dust, dirt, particulates, water, and other like debris from the intake air, and direct cleaned intake air to the engine for use in the combustion process. As shown in FIG. 1, intake system 10 may include, among other things, a pre-cleaner 12 fluidly connected to an air filter 14 via an air passage 16. Intake system 10 may further include an air passage 18 fluidly connecting air filter 14 to an intake manifold or other like intake air component of the engine. Intake system 10 may also include a fan 22 fluidly connected to an exhaust passage 24, exhaust manifold, or other like combustion exhaust component of the engine. As shown in FIG. 1, fan 22 may be fluidly connected to pre-cleaner 12 via a scavenge passage 20. It is understood that fan 22 may be configured to direct debris, removed from the intake air by pre-cleaner 12, to exhaust passage 24 via scavenge passage 20. In such embodiments, scavenge passage 20 may comprise a passage fluidly separate from, for example, air passage 16.

Air filter 14 may comprise any type of air cleaner known in the art configured to sufficiently condition intake air for use by the engine. In exemplary embodiments, pre-cleaner 12 may be configured to remove relatively large debris from the intake air and to direct such "pre-cleaned air" to the filter 14 for further cleaning. Filter 14 may be configured to remove relatively smaller debris from the pre-cleaned air. Accordingly, filter 14 may comprise paper, mesh, or other like filtration media that is relatively less porous than like filtration components of pre-cleaner 12. In exemplary embodiments, such media may be corrugated to assist in removing debris from the pre-cleaned air, and may be substantially linear, substantially cylindrical, and/or any other known shape or configuration.

Fan 22 may comprise any type of air movement device configured to apply a negative pressure (i.e., a vacuum) to pre-cleaner 12. In exemplary embodiments, fan 22 may include one or more blades, impellers, or other like air movement components (not shown), and fan 22 may be driven by any known power source associated with the engine and/or with the machine (not shown) to which the engine is operably connected. For example, fan 22 may be driven by and/or otherwise operably connected to one or more electric motors disposed on the machine. Alternatively, fan 22 may be mechanically connected to the engine by one or more belts, gears, shafts, and/or other like components. In such embodiments, fan 22 may be operably driven by and/or otherwise operably connected to the engine. Such connections may enable selective operation of fan 22, at any constant or variable speed, independent of, for example, engine speed or mode of engine operation.

Although not illustrated in FIG. 1, it is understood that the engine may be used with any stationary or mobile machine known in the art. Such machines may be used in construction, farming, mining, power generation, and/or other like applications. Accordingly, such machines may include, for example, excavators, track-type tractors, wheel loaders, on-road vehicles, off-road vehicles, generator sets, motor graders, or other like machines. The engine associated with such machines, and with intake system 10, may comprise a diesel, gasoline, natural gas, and/or other like engine known in the art.

As shown in at least FIGS. 2-6, pre-cleaner 12 may include, among other things, a base 26 including an inlet 13 and an outlet 15, a baffle 28 removably connected to base 26, a deck 60 disposed between base 26 and baffle 28, and a cover 30 removably connected to base 26. In exemplary embodiments, one or more of the above components may be omitted from pre-cleaner 12 if desired. As will be described below with respect to FIGS. 7 and 8, in further exemplary embodiments, pre-cleaner 12 may include a plenum 70 fluidly connected to base 26. Further, although not illustrated in FIGS. 2-6, it is understood that each of the exemplary pre-cleaners 12 described herein may be fluidly connected to exhaust passage 24 of the engine via fan 22 and/or scavenge passage 20.

Base 26 may comprise a substantially cylindrical housing configured to receive intake air via inlet 13, and to remove debris from the intake air via one or more filtration components disposed therein. Such intake air may enter base 26 via inlet 13 in the direction of arrows 38 shown in FIG. 3. To assist in removing such debris, base 26 may include one or more separators 32 fluidly connected to inlet 13. For example, a plurality of such separators 32 may be disposed on a substantially planar interior surface 36 of base 26. Such separators 32 may extend substantially perpendicularly from interior surface 36 in a direction away from inlet 13 and/or interior surface 36. Each separator 32 may comprise a substantially cylindrical tube-like filtration device configured to remove relatively large debris from the intake air. In exemplary embodiments in which deck 60 is disposed within base 26, separators 32 may direct the removed debris to a top surface 67 of deck 60. In such embodiments, deck 60 may substantially block debris, removed from the intake air by the plurality of separators 32, from contacting the interior surface 36 of base 26. Although illustrated in FIGS. 2 and 6, deck 60 has been omitted from FIGS. 3-5 for clarity.

Separators 32 may include one or more components configured to assist in separating debris from the intake air. Such components may include one or more vanes, fins 34, venturiis, restrictions, screens, meshes, or other like components. As shown in at least FIGS. 3-5, such fins 34 may be positioned substantially centrally within each separator 32 and may be configured to force debris carried by the intake air to an inner cylindrical wall of separator 32. For example, fins 34 may centrifugally spin intake air passing through separator 32, and may thereby force debris carried by the intake air to the inner cylindrical wall of separator 32. As a result, such separated debris may be carried by the intake air upward along the inner wall of separators 32, and may fall to surface 67 of deck 60 upon exiting the respective separators 32. In exemplary embodiments, each separator 32 may include one or more cut-outs or other like openings proximate a top of the inner wall to permit such debris to exit the respective separator 32. Alternatively, and/or in addition, baffle 28 may be sufficiently spaced from separators 32 to enable such debris to exit the respective separators 32. The relatively debris-free pre-cleaned intake air may then pass to outlet 15 in the direction of arrows 40, 42 illustrated in FIG. 3.

Base 26 may further include one or more scavenge ports 44 configured to direct debris removed from the intake air out of pre-cleaner 12. In exemplary embodiments, base 26 may include a debris collection cavity 45, and the one or more scavenge ports 44 of base 46 may be fluidly connected to collection cavity 45 and/or components thereof. For example, collection cavity 45 may be at least partially defined by interior surface 36 of base 26 and one or more interior sidewalls of base 26 extending substantially perpendicularly from interior surface 36. In such embodiments, one or more scavenge ports 44 may be fluidly connected to interior surface 36. It is understood that collection cavity 45 may comprise a substantially annular channel within which debris removed from the intake air by separators 32 may collect. One or more separators 32 of the plurality of separators 32 may be disposed within and/or may otherwise assist in forming collection cavity 45. Similarly, when baffle 28 is connected to base 26, one or more surfaces of baffle 28 (such as a substantially planar bottom surface of baffle 28 as described below) may assist in forming a top portion of collection cavity 45 opposite surface 36 and/or deck 60.

Scavenge ports 44 may each comprise an orifice 47 formed by internal surface 36 of base 26, and a substantially hollow channel 46 fluidly connected to orifice 47. In exemplary embodiments, channel 46 may be fluidly connected to scavenge passage 20 and may be configured to direct debris disposed within collection cavity 45 to exhaust passage 24 via scavenge passage 20. As will be discussed in greater detail below with respect to FIGS. 7 and 8, in further exemplary embodiments, each channel 46 may be fluidly connected to plenum 70 and may extend from a respective orifice 47 to plenum 70. For example, each scavenge port 44 may be fluidly connected to collection cavity 45 via a respective orifice 47, and scavenge ports 44 may be configured to direct debris, removed from the intake air by the plurality of separators 32, from collection cavity 45 to plenum 70. Such debris may exit pre-cleaner 12 via scavenge port 44 in the direction of arrow 48 illustrated in FIG. 3.

Figure 2:
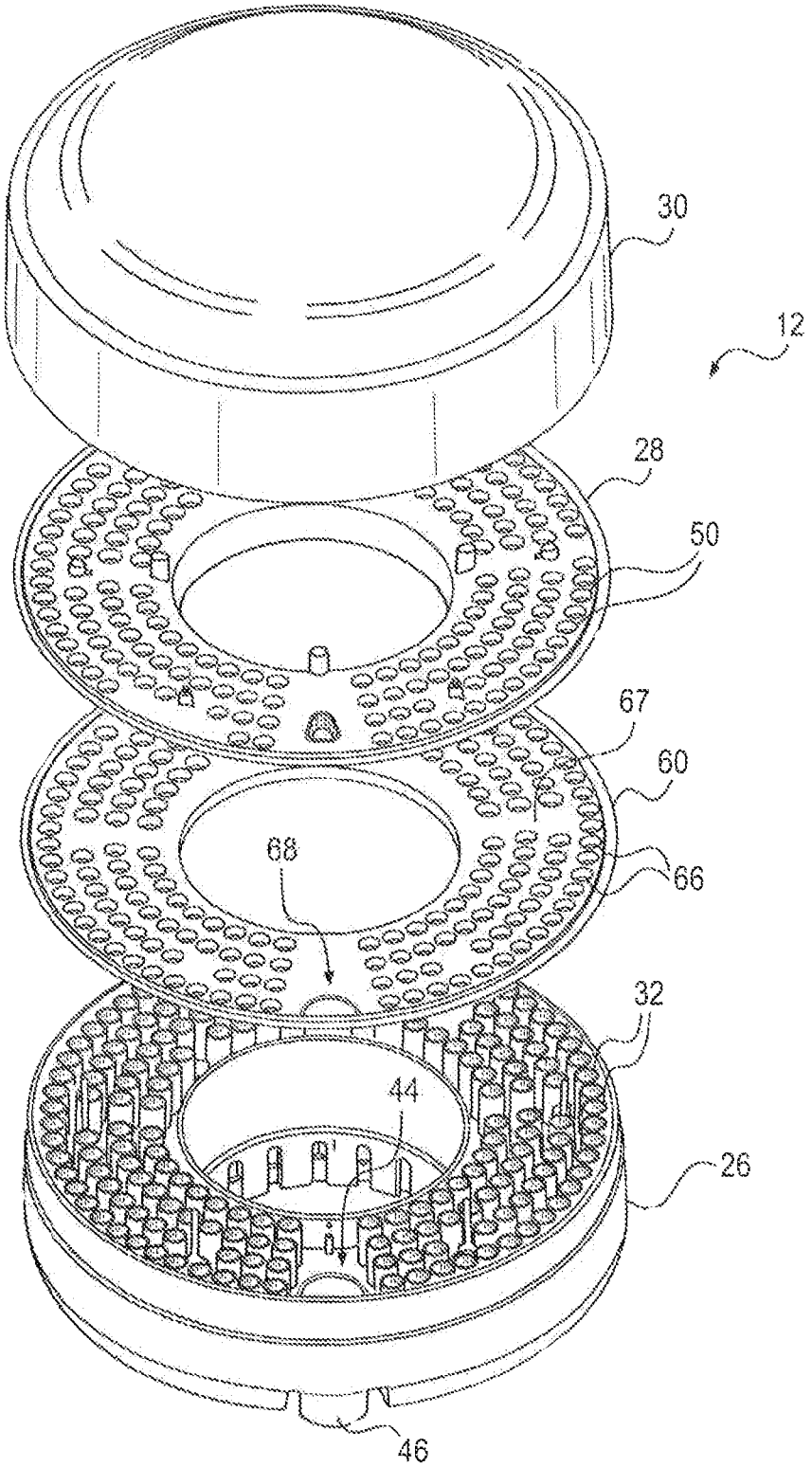
FIG. 2 is an exploded view of an exemplary disclosed pre-cleaner that may be used with the intake system of FIG. 1.
Figure 6:
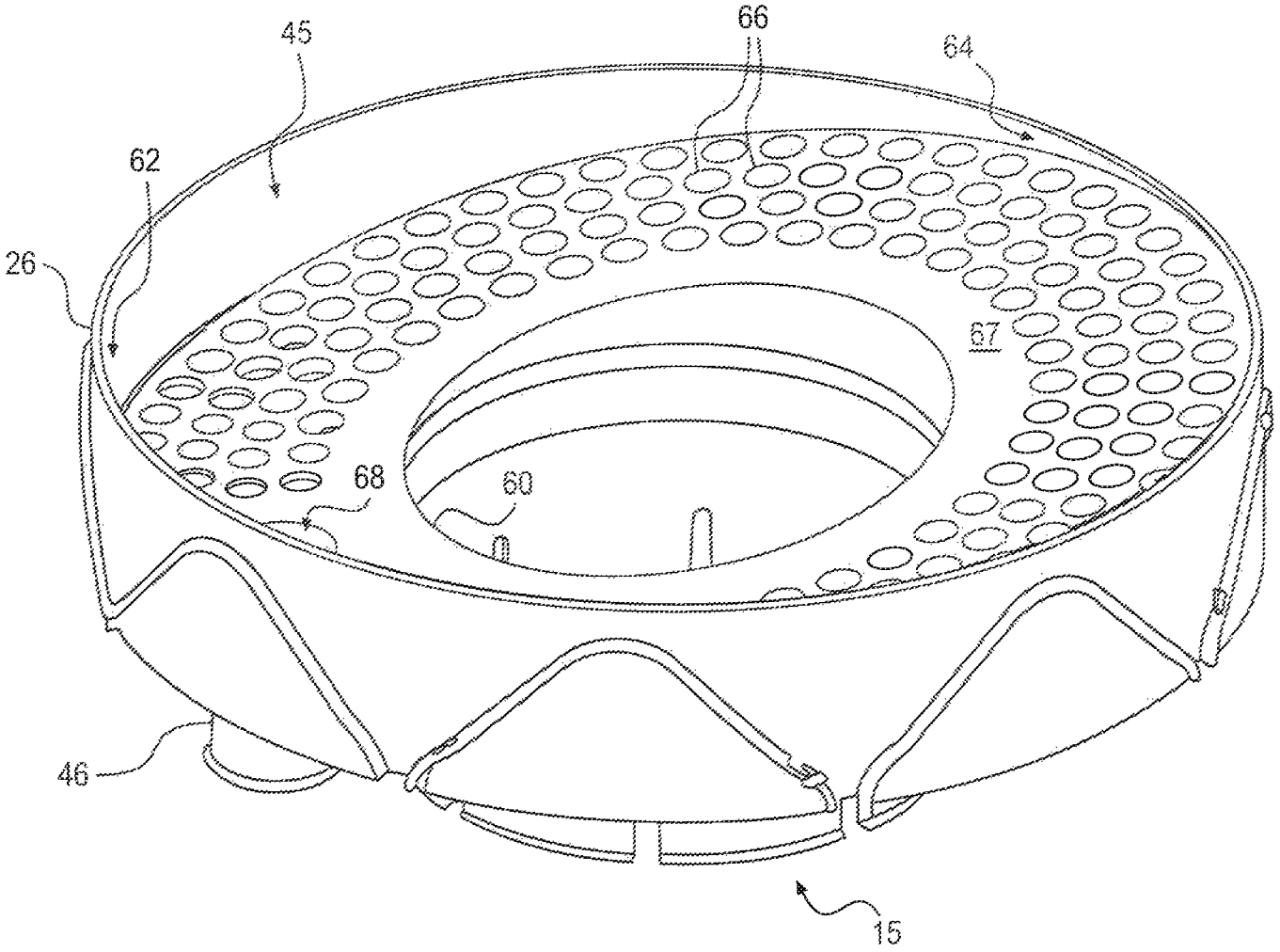
FIG. 6 is a partial assembly view of the exemplary pre-cleaner shown in FIG. 2.

As most clearly illustrated in FIGS. 2 and 6, deck 60 may comprise a substantially planar disc-like component of pre-cleaner 12 configured to assist in directing debris from collection cavity 45 to the one or more scavenge ports 44 of base 26. Deck 60 may comprise, for example, a substantially planar top surface 67, a bottom surface (not shown) opposite top surface 67, and a plurality of thru holes 66 formed in top surface 67 and extending to the bottom surface. Deck 60 may be shaped, sized, and/or otherwise configured to be disposed within collection cavity 45 proximate interior surface 36. For example, deck 60 may be removably connected to base 26 via one or more mounts 56 (FIG. 5) disposed on interior surface 36, and deck 60 may include one or more mounts (not shown) disposed on, for example, the bottom surface thereof configured to mate with corresponding mounts 56 of base 26. Alternatively, deck 60 may include one or more stands (not shown) disposed on the bottom surface thereof and configured to contact interior surface 36 when deck 60 is disposed within collection cavity 45.

In exemplary embodiments, deck 60 may be positioned within base 26 between interior surface 36 and baffle 28, and may be positioned at an acute angle relative to the interior surface 36. For example, top surface 67 and/or the bottom surface of deck 60 may be disposed at an acute included angle relative to interior surface 36. In such embodiments, a first portion 62 of deck 60 may be disposed closer to interior surface 36 than a second portion 64 of deck 60. As shown in the exemplary embodiment of FIG. 6, first portion 62 may be disposed on an opposite side of deck 60 than second portion 64. It is understood that an axial direction associated with pre-cleaner 12 may be, for example, a direction substantially perpendicular to interior surface 36 and/or a direction substantially parallel to a longitudinal axis (not shown) of base 26. Accordingly, when deck 60 and baffle 28 are connected to base 26, first portion 62 of deck 60 may be disposed a first axial distance from baffle 28, and second portion 64 of deck 60 may be disposed a second axial distance from baffle 28 less than the first axial distance. In such embodiments, the first and second axial distances may comprise, for example, linear axial distances measured from top surface 67 of deck 60 to the bottom surface (not shown) of baffle 28. Likewise, first portion 62 may be disposed a third axial distance from interior surface 36 and second portion 64 may be disposed a fourth axial distance from interior surface 36 greater than the third axial distance. Further, at least one of first and second portions 62, 64 may be disposed proximate scavenge port 44.

As noted above, deck 60 may be shaped, sized, and/otherwise configured to substantially block debris, removed from intake air by the plurality of separators 32, from contacting interior surface 36. Instead, such debris may pass from separators 32 to top surface 67, and may be directed to the one or more scavenge ports 44 of base 26 by top surface 67. Deck 60 may be dimensioned such that a negligible gap may be formed between an outer perimeter of deck 60 and the one or more interior sidewalls of base 26. In such embodiments, the size of such a gap may be minimized to reduce and/or substantially eliminate the amount of debris passing therethrough and onto interior surface 36.

Each thru hole 66 of the plurality of thru holes 66 may be configured to mate with a corresponding separator 32 of base 26. For example, each separator 32 of the plurality of separators 32 may pass substantially through a respective thru hole 66 of the plurality of thru holes 66. Thru holes 66 may be shaped, sized, and/or otherwise configured to accept passage of a respective separator 32 therethrough. For example, as described above with respect to the gap formed between the one or more interior sidewalls of base 26 and the outer perimeter of deck 60, each thru hole 66 may be positioned and dimensioned such that a negligible gap is formed between the outer wall of a respective separator 32 and an inner diameter of the thru hole 66. In such embodiments, the size of such a gap may be minimized to reduce and/or substantially eliminate the amount of debris passing therethrough and onto interior surface 36. Moreover, in exemplary embodiments, each thru hole 66 may be formed in deck 60 at an angle, relative to top surface 67, that is complementary with the acute angle at which deck 60 is disposed within base 26. Such a complementary angle may be formed between the outer wall of each separator 32 and top surface 67 in embodiments in which deck 60 is positioned at an acute angle relative to interior surface 36 and in which separators 32 extend substantially perpendicularly from interior surface 36. Thus, forming thru holes 66 at such a complementary angle relative to top surface 67 may assist in minimizing the size of the gaps formed between the outer wall of each respective separator 32 and the inner diameter of each corresponding thru hole 66.

As shown in FIGS. 2 and 6, deck 60 may further include at least one scavenge feature 68. Each scavenge feature 68 may be configured to mate with and may be fluidly connected to a corresponding scavenge port 44 of base 26. Such scavenge features 68 may comprise, for example, an orifice formed by top surface 67, and a substantially hollow channel, extension, or other like component (not shown) configured to mate with a respective scavenge port 44 when deck 60 is disposed within collection cavity 45. In exemplary embodiments, scavenge feature 68 may be shaped, sized, and/or otherwise configured such that scavenge port 44 may accept at least a portion of scavenge feature 68 therein. For example, a channel of scavenge feature 68 may extend from top surface 67 and/or the bottom surface of deck 60 into orifice 47 of scavenge port 44. In such embodiments, the channel and/or other components of scavenge feature 68 may form a substantially fluid-tight seal with scavenge port 44 such that debris directed from top surface 67 to scavenge port 44 via scavenge feature 68 may not escape. Scavenge feature 68 and/or scavenge port 44 may include one or more seals, O-rings, gaskets and/or other like devices configured to assist in forming such a seal. In exemplary embodiments, the channel of scavenge feature 68 may comprise a relatively flexible hose, pipe, tube, or other like component to facilitate mating scavenge feature 68 with scavenge port 44. Such a flexible component may assist in mating scavenge feature 68 with scavenge port 44 when deck 60 is positioned within base 26 at, for example, the acute angle described above. In other exemplary embodiments, a channel of scavenge feature 68 may extend from top surface 67 and/or the bottom surface of deck 60 at an angle, relative to top surface 67, that is complementary with the acute angle at which deck 60 is disposed within base 26.

It is understood that disposing deck 60 within collection cavity 45 at an acute angle relative to interior surface 36 may affect fluid flow within collection cavity 45 and, in particular, proximate top surface 67. For example, when disposed as shown in FIG. 6, first portion 62 of deck 60 may form a first flow zone within collection cavity 45 proximate scavenge feature 68 and scavenge port 44. Likewise, when disposed as shown in FIG. 6, second portion 64 of deck 60 may form a second flow zone within collection cavity 45 opposite the first flow zone, scavenge feature 68, and scavenge port 44. In such embodiments, the velocity of air and/or debris flow within collection cavity 45 may be dictated by the relative size and location of such flow zones. For example, since first portion 62 of deck 60 may be disposed closer to interior surface 36 than second portion 64, when deck 60 and baffle 28 are connected to base 26, the volume of the first flow zone may be relatively larger than a corresponding volume of the second flow zone. In such embodiments, the second flow zone may, thus, form a greater flow restriction to air passing through collection cavity 45 proximate top surface 67 than the first flow zone. Accordingly, air passing through collection cavity 45 proximate top surface 67 may be at a relatively higher pressure (and may travel at a relatively higher velocity) in the second flow zone than in the first flow zone. Accordingly, the first flow zone may be characterized by a first flow velocity that is less than a corresponding second flow velocity of the second flow zone. It is understood that in such embodiments, air and/or debris may be directed to flow within collection cavity 45 and proximate top surface 67 due to a negative pressure applied to collection cavity 45, by fan 22, via scavenge port 44 and/or scavenge feature 68. The relatively high pressure and relatively high flow velocity created at the second flow zone may assist in removing debris collected proximate and/or within the second flow zone and disposed on an opposite side of deck 60 than scavenge port 44.

In exemplary embodiments, deck 60 may be formed as a separate component of base 26 and may be disposed within collection cavity 45 during assembly of pre-cleaner 12. In further exemplary embodiments, deck 60 may be configured as a substantially annular inclined plane. In such embodiments, first portion 62 of deck 60 may have a first axial thickness and second portion 64 may have a second axial thickness greater than the first axial thickness of first portion 62. In still further exemplary embodiments, deck 60 may be formed directly onto interior surface 36 of base 26. For example, in such embodiments deck 60 may be formed of any known curable material. Such materials may include, for example, molten and/or substantially liquid rubber, plastic, polymers, resins, and the like. In forming deck 60 from such materials, the material may be disposed onto interior surface 36 while in substantially liquid form. The substantially liquid material may then be allowed to cool, harden, solidify, and/or otherwise substantially cure on interior surface 36, thereby forming top surface 67, first portion 62, second portion 64, and other components of deck 60. It is understood that, as part of the curing process, the substantially liquid material may be guided to surround each separator 32 of the plurality of separators 32 such that the formed deck 60 substantially surrounds each separator 32 with substantially no gap therebetween. Likewise, during the curing process, the substantially liquid material may be guided to about the one or more interior sidewalls of base 26 such that deck 60 is formed substantially adjacent the one or more interior sidewalls with substantially no gap therebetween. Additionally, in exemplary embodiments base 26 may be maintained at the acute angle described above during the curing process such that first portion 62 of the formed deck 60 may be formed with a first axial thickness and second portion 64 may be formed with a second axial thickness greater than the first axial thickness of first portion 62.

Figure 3:
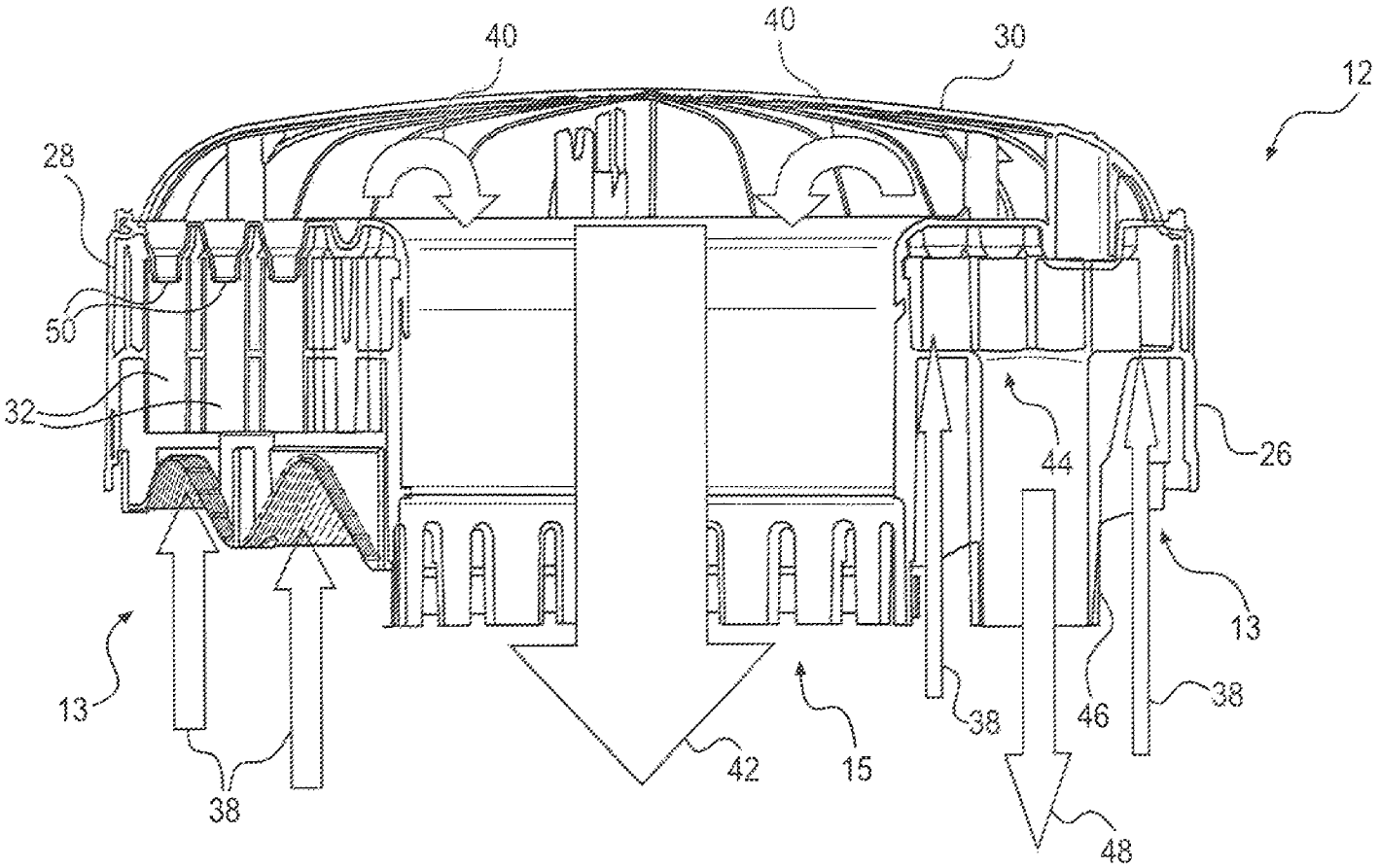
FIG. 3 is a cut-away view of a portion of the exemplary pre-cleaner shown in FIG. 2.
Figure 4:
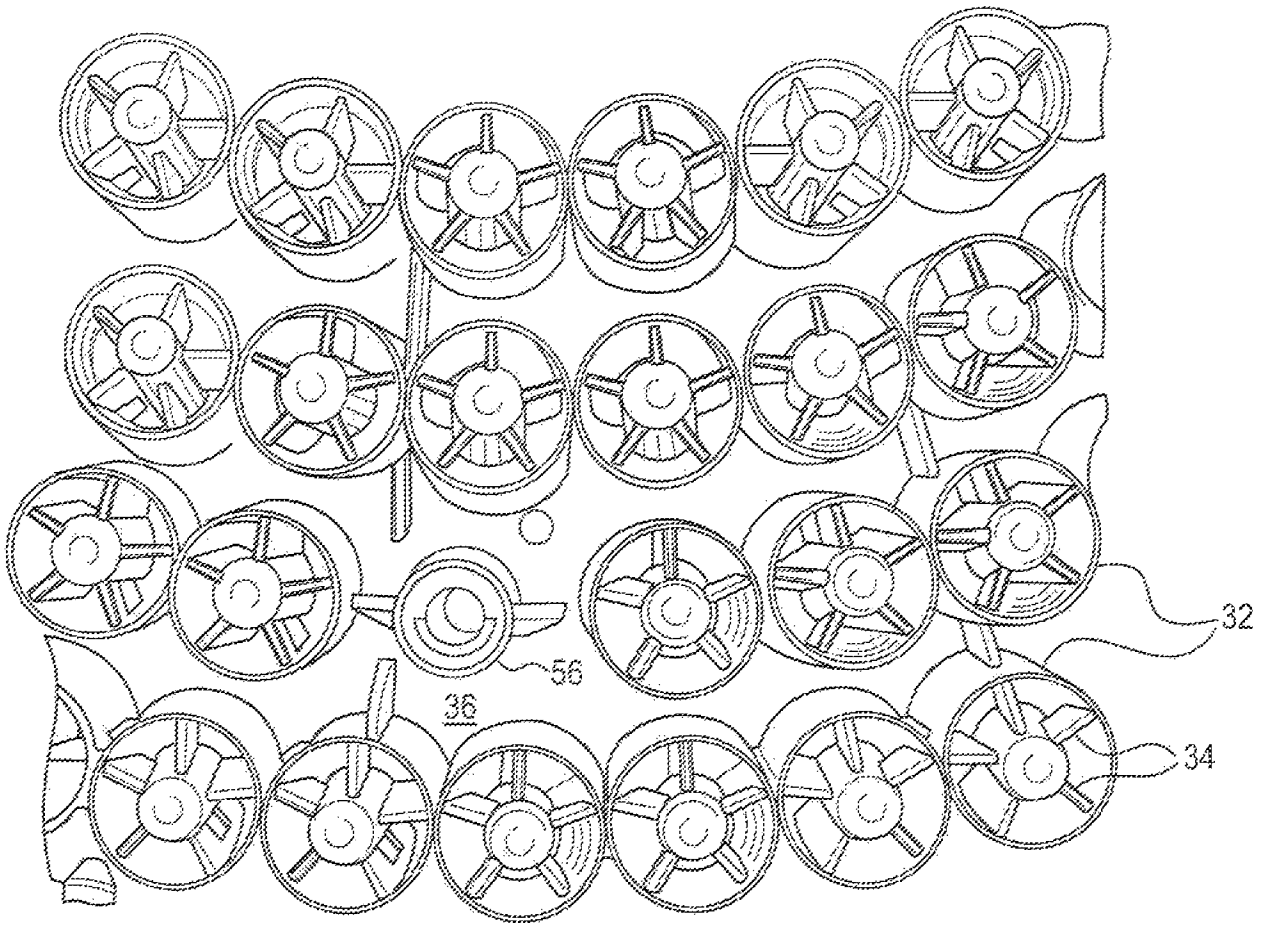
FIG. 4 is a plan view of a portion of the exemplary pre-cleaner shown in FIG. 2.
Figure 5:
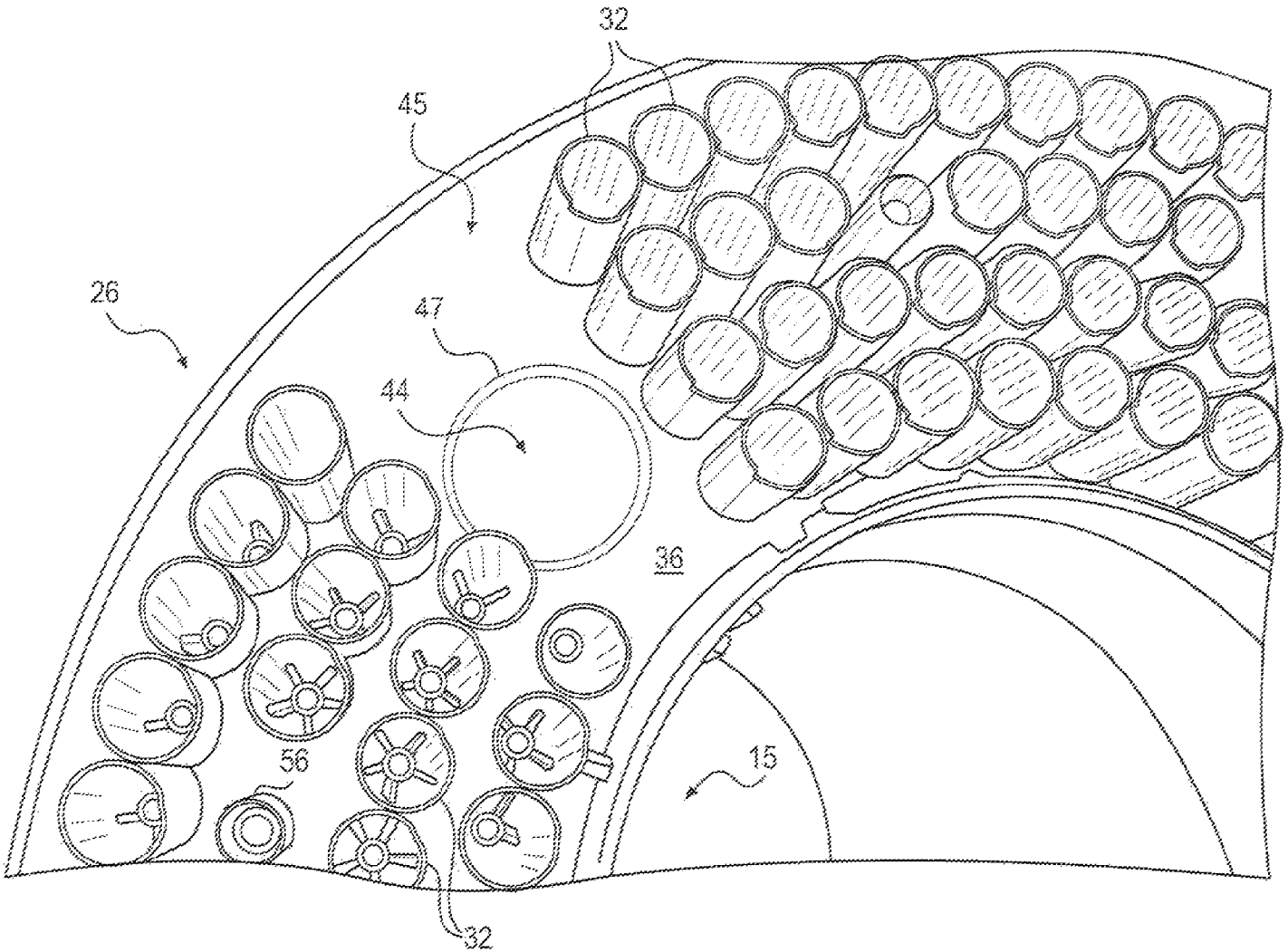
FIG. 5 is a plan view of another portion of the exemplary pre-cleaner shown in FIG. 2.

With continued reference to at least FIGS. 2 and 3, baffle 28 may comprise a substantially planar disc-like component of pre-cleaner 12 configured to assist in directing debris exiting separators 32 to top surface 67 of deck 60 while directing pre-cleaned intake air to outlet 15. Baffle 28 may be removably connected to base 26, opposite interior surface 36, via mounts 56. In such embodiments, baffle 28 may include one or more corresponding mounts or other like mounting devices (not shown) configured to mate with respective mounts 56 of base 26. It is understood that in exemplary embodiments in which deck 60 is disposed within base 26, such mounts 56 of base 26 may pass substantially through deck 60 to facilitate coupling baffle 28 to base 26. Alternatively, in such embodiments, baffle 28 may be removably coupled directly to deck 60, and may be removably connected to base 26 via such a direct removable coupling with deck 60.

Baffle 28 may include, for example, a substantially planar top surface and a substantially planar bottom surface opposite the top surface. At least a portion of the bottom surface of baffle 28 may be configured to engage and/or otherwise mate with one or more separators 32 of the plurality of separators 32. For example, baffle 28 may include one or more separator features 50, and each separator feature 50 may be configured to mate with a respective separator 32 of base 26. Such separator features 50 may comprise substantially cylindrical or substantially conical protuberances extending from the bottom surface of baffle 28. In exemplary embodiments, such separator features 50 may be disposed at least partially within a top portion of a respective separator 32 when the baffle 28 is connected to base 26. Such separator features 50 may be sized, shaped, and/or otherwise configured to extend around an outer diameter or outer surface of the respective separator 32 or, alternatively, such separator features 50 may be sized, shaped, and/or otherwise configured for insertion within the inner cylindrical wall of the respective separator 32. In exemplary embodiments, a distal end of each separator feature 50 mating with the respective separator 32 may be substantially fluidly closed so as to assist in directing pre-cleaned intake air to outlet 15.

As mentioned above, and as shown in FIGS. 7 and 8, in additional exemplary embodiments plenum 70 may be fluidly connected to scavenge port 44 of base 26 via channel 46, and plenum 70 may be disposed, for example, proximate an exterior surface 54 of base 26 opposite interior surface 36. In such exemplary embodiments, pre-cleaner 12 may include a plurality of scavenge ports 44 disposed at various locations on and/or within base 26. Such locations may be, for example, at approximately 90 degree intervals proximate a perimeter of base 26. In such embodiments, plenum 70 may be fluidly connected to each scavenge port 44 of the plurality of scavenge ports 44, and may be configured to direct debris from pre-cleaner 12 to exhaust passage 24 via the plurality of scavenge ports 44.

Figure 7:
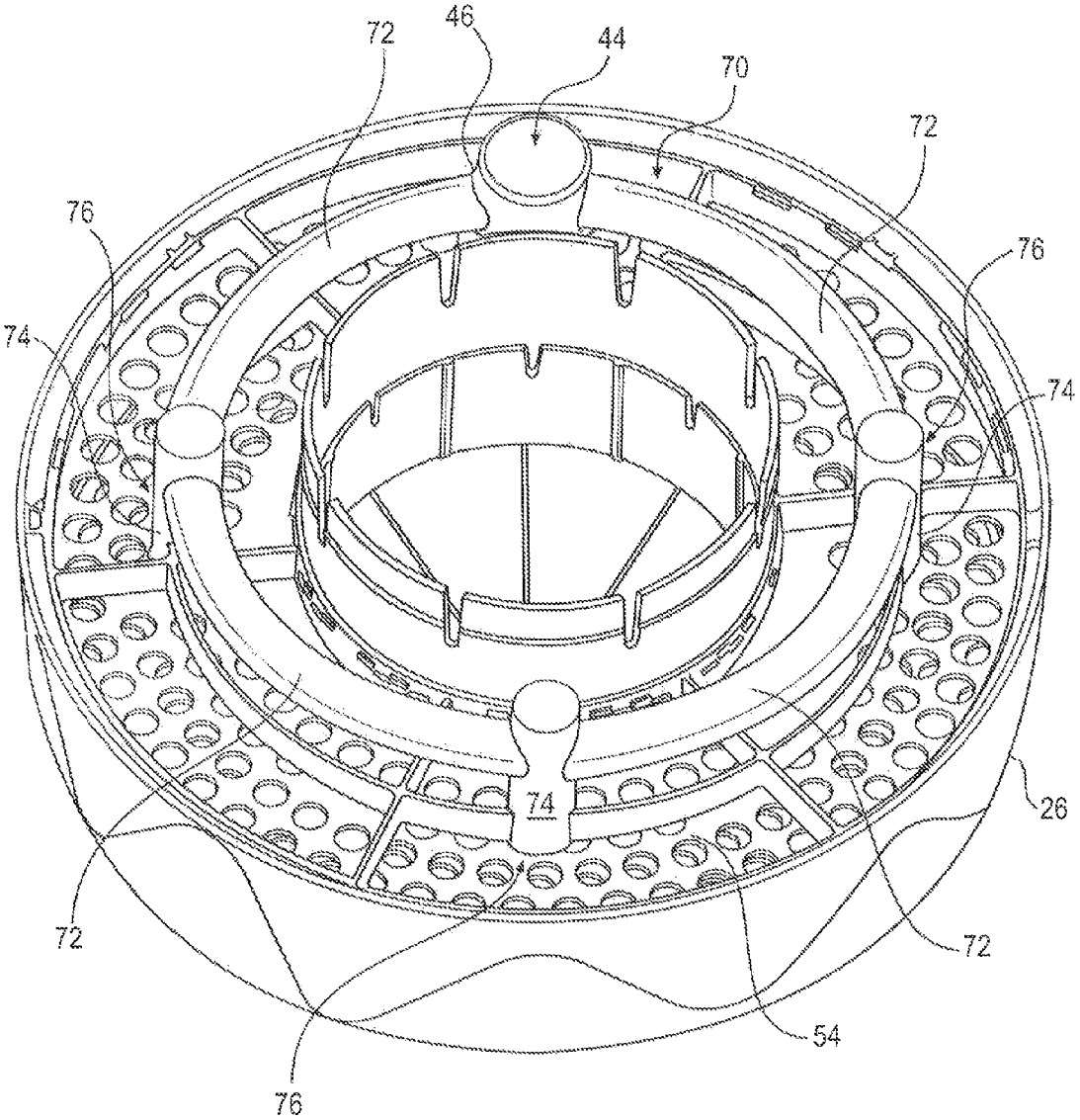
FIG. 7 illustrates a pre-cleaner according to another exemplary embodiment of the present disclosure.
Figure 8:
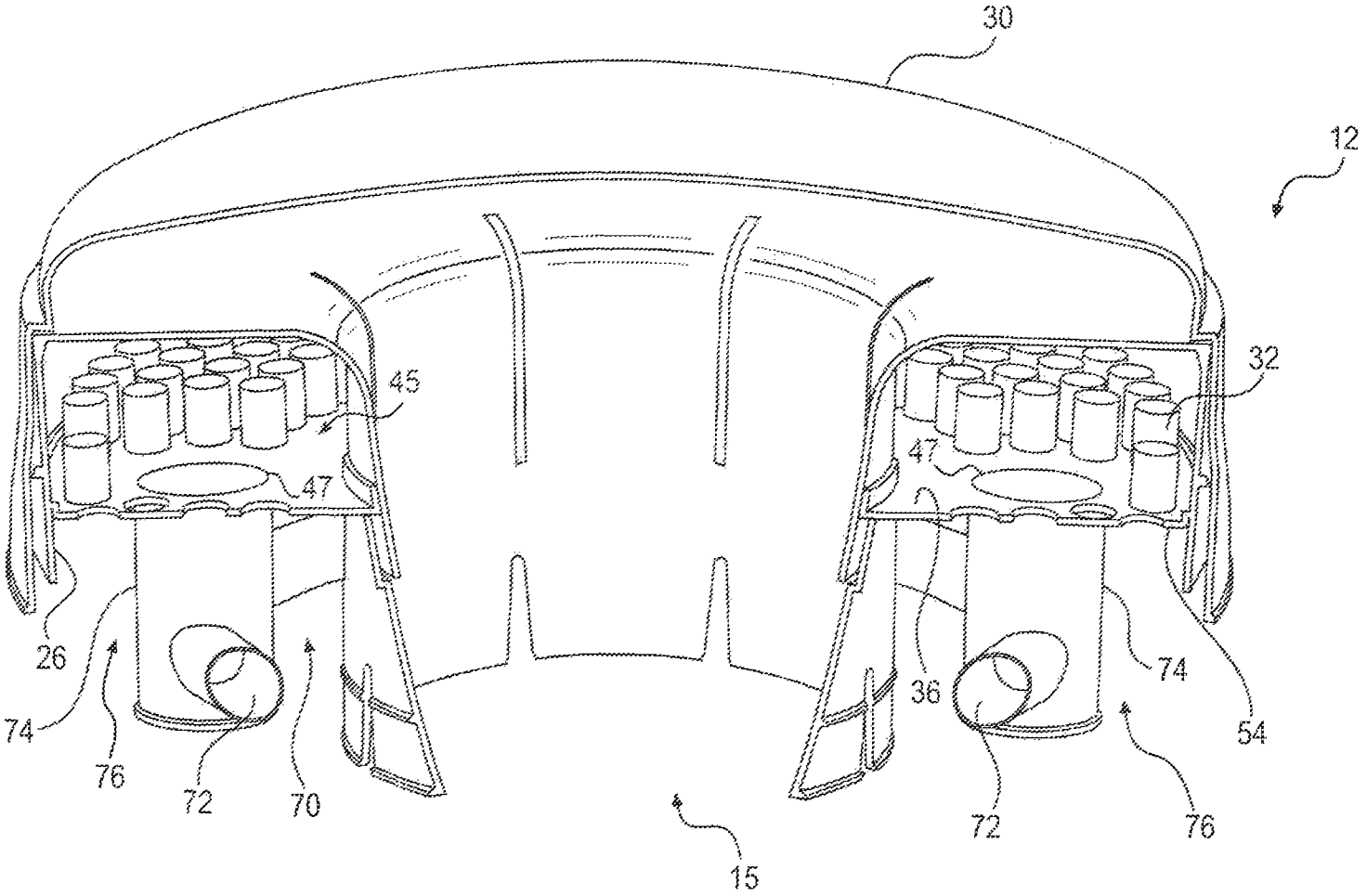
FIG. 8 is a cut-away view of a portion of the exemplary pre-cleaner shown in FIG. 7.

Plenum 70 may comprise a substantially hollow, substantially cylindrical, tube-like manifold configured to transfer debris and/or air from the one or more scavenge ports 44 to scavenge passage 20. As shown in FIG. 7, plenum 70 may be substantially circular and/or any other shape known to minimize the restriction of fluid flow therein. In exemplary embodiments, plenum 70 may comprise a plurality of substantially hollow, substantially cylindrical legs 72. Each leg 72 of the plurality of legs 72 may be fluidly connected to, for example, a respective scavenge port 44 of the plurality of scavenge ports 44. In particular, each leg 72 may extend between a pair of adjacently positioned channels 46 associated with the respective scavenge ports 44. The length, radius, inner diameter, and/or other configurations of each leg 72 may be substantially identical. Alternatively, in further embodiments, such as embodiments in which base 26, internal surface 36 and/or collection cavity 45 have a substantially square, substantially rectangular, substantially pentagonal, and/or other shape, the configuration of one or more legs 72 may be altered to match the configuration of a respective component or portion of base 26. Additionally, the inner diameter of one or more legs 72 may be reduced, enlarged, tapered, treated, and/or otherwise modified to affect fluid flow therein. For example, an inner diameter of one or more legs 72 may be reduced or enlarged relative to the remainder of legs 72 to correspondingly increase or decrease the flow rate of air and/or debris therethrough.

In exemplary embodiments, each of the scavenge ports 44 described herein may have substantially the same shape, size, inner diameter, and/or other configuration to assist in directing debris, removed from the intake air by separators 32, from collection cavity 45 to plenum 70. Alternatively, as shown in at least FIG. 7, pre-cleaner 12 may include a primary scavenge port 44 and a plurality of secondary or additional scavenge ports 76. Primary scavenge port 44 may be associated with a respective primary orifice 47 formed by interior surface 36, and a respective primary channel 46 fluidly connecting plenum 70 to collection cavity 45 via primary orifice 47. Similarly, additional scavenge ports 76 may be associated with respective secondary or additional orifices 47 formed by interior surface 36. Additional scavenge ports 76 may further include respective secondary or additional channels 74 fluidly connecting plenum 70 to collection cavity 45 via respective additional orifices 47. In such embodiments, primary orifice 47 and/or primary channel 46 may have a different inner diameter than one or more of additional orifices 47 and/or additional channels 74. For example, primary orifice 47 may have a larger inner diameter than one or more of additional orifices 47. Likewise, primary channel 46 may have a larger inner diameter than one or more of additional channels 74. The presence of additional scavenge ports 76 may improve the debris removal capabilities of pre-cleaner 12 relative to pre-cleaners having a single scavenge port 44, and by modifying the diameter of one or more of the components of additional scavenge ports 76, pre-cleaner 12 may be tuned to further improve such debris removal capabilities.

Industrial Applicability

The intake systems 10 of the present disclosure have wide application in a variety of machine types including, for example, machines employed in mining, construction, farming, and power generation applications. The disclosed intake systems 10 find particular applicability in machines operating in environments characterized by high levels of airborne dust, dirt, water, particulates, and other known debris. By equipping or retrofitting machines with intake systems 10 of the present disclosure, damage to various components of such machines may be reduced and the operational efficiency of such machines may be improved.

For example, pre-cleaners 12 of the present disclosure may be characterized by improved debris removal capabilities relative to known pre-cleaners. The sloped and/or angled deck 60 described herein may, for example, utilize the effects of gravity to assist in directing debris collected on top surface 67 to the one or more scavenge ports 44 of base 26. First and second flow zones formed by respective first and second portions 64, 64 of deck 60 may further assist in directing such collected debris to the one or more scavenge ports 44. For example, the relatively high flow velocity associated with the second flow zone described herein may assist in removing collected debris disposed in locations within collection cavity 45 remote from primary scavenge port 44.

Moreover, the multi-scavenge port base 26 and/or multi-leg plenum 70 configurations described herein may enable pre-cleaners 12 of the present disclosure to remove collected debris directly from various locations spaced about collection cavity 45. By applying a direct negative pressure (supplied by fan 22 fluidly connected to plenum 70) at multiple locations within collection cavity 45, debris removal may be improved over known single-scavenge port pre-cleaner designs. As a result of the various components and configurations described herein, pre-cleaners 12 of the present disclosure experience reduced levels of separator clogging and require less frequent pre-cleaner maintenance as compared to known pre-cleaners.

Further, by incorporating a fan 22 or other negative pressure supply device capable of operating independently of engine speed, intake system 10 is configured to supply desired levels of negative pressure to pre-cleaner 12 during all modes of engine and/or machine operations. In particular, such independent control of fan 22 facilitates directing required levels of negative pressure to collection cavity 45 for debris removal during engine idle or other modes of engine operation characterized by relatively low engine speed. Known intake systems supplying negative pressure to associated pre-cleaners utilizing, for example, venturi devices disposed within an engine exhaust manifold are not capable of such low-engine speed debris removal. Additionally, whereas such venturi-based intake systems are prone to damage caused by relatively high temperature exhaust being directed to the pre-cleaner and other intake system components, intake system 10 of the present disclosure eliminates the threat of such damage.

It will be apparent to those skilled in the art that various modifications and variations can be made to the intake systems 10 of the present disclosure without departing from the scope of the disclosure. For example, as noted above, one or more of independently controlled fan 22, sloped and/or angled deck 60, multi-scavenge port 44 base 26, and multi-leg plenum 70 may be combined and/or otherwise incorporated into a single intake system 10. Various combinations of such components and/or configurations may further improve the debris removal capabilities of the resulting intake system 10. Other embodiments will be apparent to those skilled in the art from consideration of the specification and practice of the embodiments disclosed herein. It is intended that the specification and examples be considered as exemplary only, with a true scope of the disclosure being indicated by the following claims and their equivalents.

What is claimed is:

1. A pre-cleaner for use with an internal combustion engine, comprising:

a base including a substantially planar interior surface, a scavenge port, and a plurality of separators extending substantially perpendicularly from the interior surface;

a baffle removably connected to the base, the baffle including a plurality of separator features configured to mate with the plurality of separators; and a deck disposed between the interior surface and the baffle, the deck being positioned at an acute angle relative to the interior surface such that a first portion of the deck is disposed closer to the interior surface than a second portion of the deck.

2. The pre-cleaner of claim 1, wherein the deck is substantially planar, and the first portion of the deck is disposed proximate the scavenge port.

3. The pre-cleaner of claim 1, wherein the deck comprises a plurality of thru holes configured to mate with the plurality of separators, wherein each separator of the plurality of separators passes substantially through a respective thru hole of the plurality of thru holes.

4. The pre-cleaner of claim 1, wherein the deck comprises a scavenge feature configured to mate with the scavenge port of the base.

5. The pre-cleaner of claim 4, wherein the scavenge feature comprises an orifice fluidly connected to the scavenge port.

6. The pre-cleaner of claim 1, wherein the deck is disposed within a collection cavity of the base, the first portion of the deck forming a first flow zone within the cavity proximate the scavenge port and the second portion of the deck forming a second flow zone within the cavity opposite the scavenge port, wherein the first flow zone is characterized by a first flow velocity less than a second flow velocity of the second flow zone.

7. The pre-cleaner of claim 1, wherein the first portion of the deck is disposed a first axial distance from the baffle, and the second portion of the deck is disposed a second axial distance from the baffle less than the first axial distance.

8. The pre-cleaner of claim 1, wherein the deck is configured to substantially block debris, removed from intake air by the plurality of separators, from contacting the interior surface of the base, and to direct the blocked debris to the scavenge port.

9. The pre-cleaner of claim 1, wherein the deck is formed by disposing a curable substantially liquid material on the interior surface, and permitting the material to substantially cure on the interior surface, the cured material forming the first and second portions of the deck.

10. The pre-cleaner of claim 9, wherein permitting the material to substantially cure on the base includes substantially surrounding each separator of the plurality of separators with the substantially liquid material such that the formed deck substantially surrounds each separator.

11. The pre-cleaner of claim 1, wherein the base includes an additional scavenge port, the pre-cleaner further including a plenum fluidly connected to the scavenge ports.

12. The pre-cleaner of claim 1, wherein the scavenge port is fluidly connected to an exhaust passage of the engine via a fan.

13. A pre-cleaner for use with an internal combustion engine, comprising:

a base including a substantially planar interior surface, a plurality of scavenge ports fluidly connected to the interior surface, and a plurality of separators extending substantially perpendicularly from the interior surface;

a baffle removably connected to the base opposite the interior surface and configured to mate with the plurality of separators;

a plenum fluidly connected to the plurality of scavenge ports and disposed proximate an exterior surface of the base opposite the interior surface; and a deck disposed between the baffle and the interior surface of the base, the deck having a substantially planar top surface disposed at an acute included angle relative to the interior surface of the base.

14. The pre-cleaner of claim 13, wherein each scavenge port of the plurality of scavenge ports comprises an orifice formed by the interior surface of the base, and a channel extending from the orifice to the plenum.

15. The pre-cleaner of claim 13, wherein the plenum comprises a plurality of substantially hollow legs, each leg of the plurality of legs being fluidly connected to a respective scavenge port of the plurality of scavenge ports.

16. The pre-cleaner of claim 13, wherein the plurality of scavenge ports comprises a primary scavenge port associated with a first orifice formed by the interior surface and a secondary scavenge port associated with a second orifice formed by the interior surface, the first orifice having a larger diameter than the second orifice.

17. The pre-cleaner of claim 13, wherein the plurality of scavenge ports is fluidly connected to a collection cavity formed by the base, the plurality of scavenge ports being configured to direct debris, removed from intake air by the plurality of separators, from the collection cavity to the plenum.

18. The pre-cleaner of claim 13, wherein the deck includes a plurality of scavenge features configured to mate with the plurality of scavenge ports of the base.

19. The pre-cleaner of claim 13, wherein the plenum is fluidly connected to an exhaust passage of the engine via a fan.

20. An intake system for use with an internal combustion engine, comprising:

a pre-cleaner having a base including an inlet, an outlet, and a scavenge port, the inlet configured to receive intake air, and the scavenge port comprising an orifice formed by a substantially planar interior surface of the base;

an air filter fluidly connected to the outlet and configured to receive pre-cleaned air from the outlet;

an exhaust passage fluidly connected to the engine and the scavenge port, the exhaust passage configured to receive combustion exhaust from the engine and to receive debris removed from the intake air by the pre-cleaner; and a fan fluidly connected to the exhaust passage and configured to direct the debris from the pre-cleaner to the exhaust passage via the orifice of the scavenge port, wherein the pre-cleaner further includes a deck having a substantially planar top surface disposed at an acute included angle relative to the interior surface of the base, the deck being configured to substantially block the debris removed from the intake air from contacting the interior surface of the base and to direct the blocked debris to the scavenge port.

21. The system of claim 20, wherein the pre-cleaner further includes a plurality of scavenge ports fluidly connected to the interior surface of the base and a plenum fluidly connected to the plurality of scavenge ports, the fan being configured to direct the debris to the exhaust passage via the plenum.

22. The system of claim 21, wherein each scavenge port of the plurality of scavenge ports comprises a respective orifice formed by the interior surface and a respective channel extending from the orifice to the plenum.

23. The system of claim 20, wherein the deck further includes a scavenge feature configured to mate with the scavenge port of the base.

* * * * *